United States Patent [19]

McIntosh et al.

[11] 3,976,966

[45] Aug. 24, 1976

[54] ELECTRIC SEQUENCER AND ELECTRIC HEATING SYSTEM

[75] Inventors: Harold A. McIntosh; Hollis L. Randolph; Bradford N. Hull, all of Los Angeles, Calif.

[73] Assignee: Robertshaw Controls Company, Richmond, Va.

[22] Filed: Aug. 6, 1974

[21] Appl. No.: 495,167

[52] U.S. Cl. ..... 337/104; 337/100; 337/102; 337/107; 337/379

[51] Int. Cl.[2] ..... H01H 61/00

[58] Field of Search ..... 337/100, 101, 102, 104, 337/111, 347, 379; 29/191, 194, 400, 470, 148, 188, 195.5, 191.6; 200/67 AD

[56] References Cited

UNITED STATES PATENTS

| | | | |
|---|---|---|---|
| 2,266,537 | 12/1941 | Elmer | 200/67 DA |
| 3,004,203 | 10/1961 | Epstein | 337/104 X |
| 3,845,441 | 10/1974 | Place | 337/347 |

*Primary Examiner*—Donovan F. Duggan
*Assistant Examiner*—Fred E. Bell
*Attorney, Agent, or Firm*—Anthony A. O'Brien

[57] ABSTRACT

An electrical sequencing relay has an elongated bimetal member with a transverse curvature opposing temperature warp and maintaining the member straight in a longitudinal direction until longitudinal temperature warp forces exceeds the retaining forces of the transverse curvature. A slidable insulative operator is engaged by a free end of the bimetal member to operate an electrical switch when the bimetal member abruptly changes its longitudinal curvature.

16 Claims, 13 Drawing Figures

FIG. 1
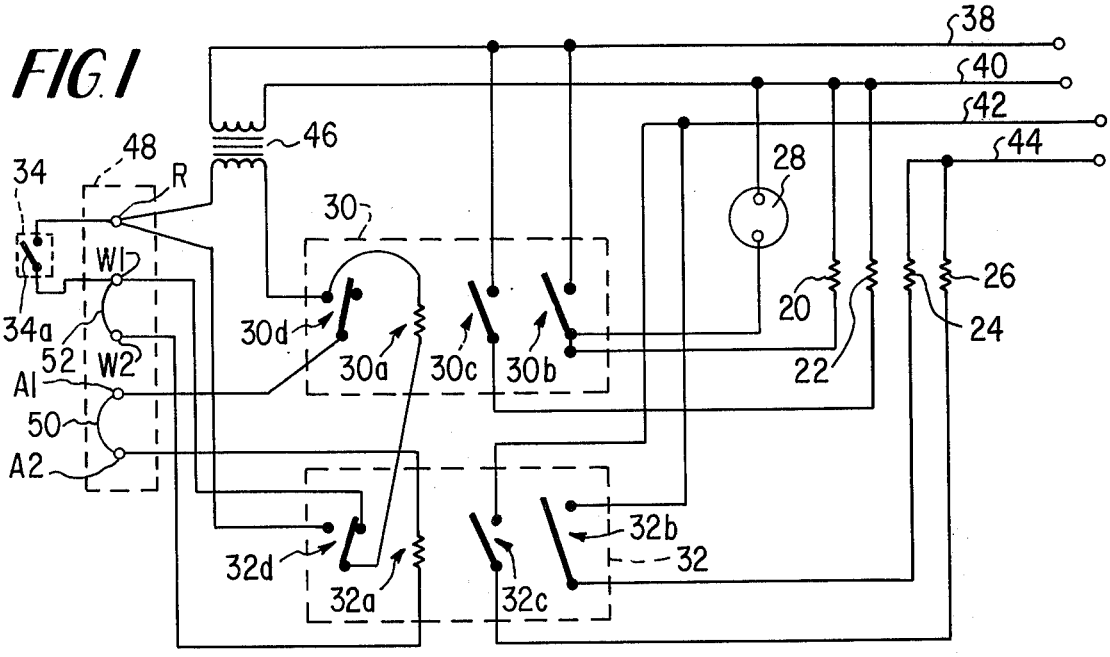
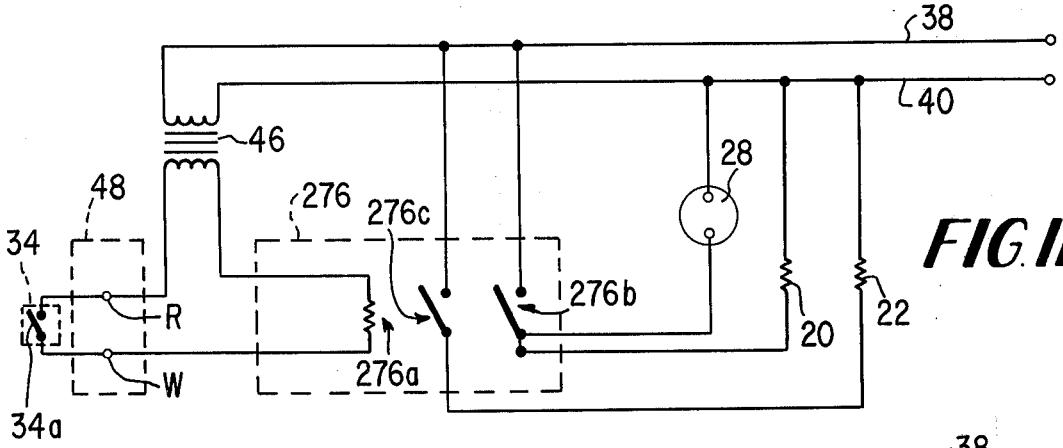
FIG. 11
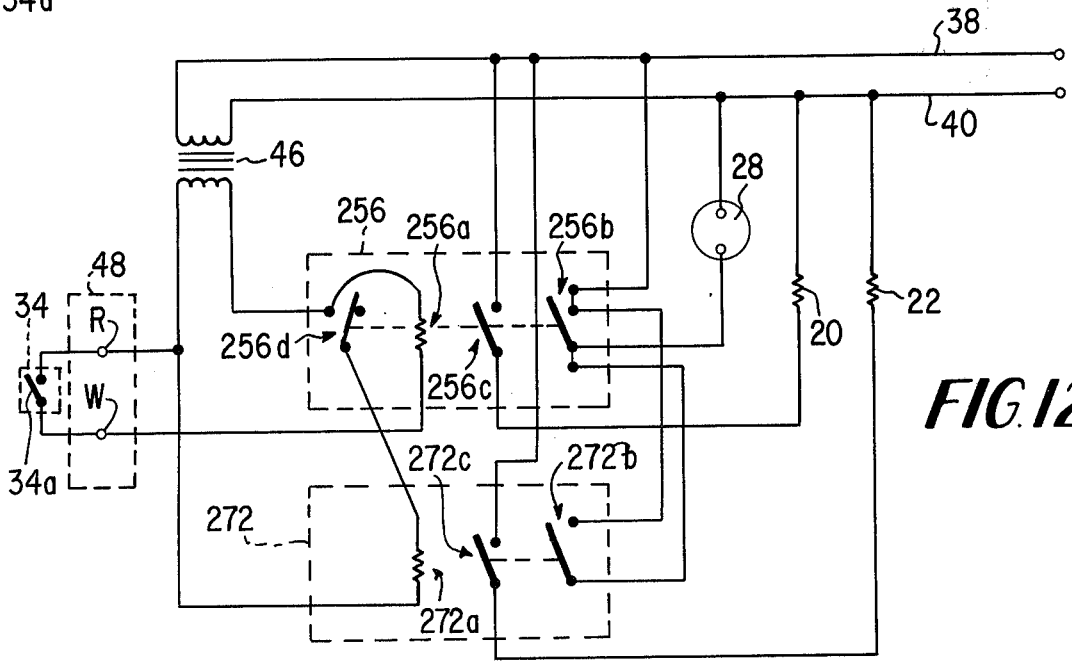
FIG. 12

ELECTRIC SEQUENCER AND ELECTRIC HEATING SYSTEM

BACKGROUND OF THE INVENTION

1. Field of the Invention:

The invention relates to electric sequencing relays and to heating systems employing electric sequencing relays for sequentially energizing electric heating elements.

2. Description of the Prior Art:

The prior art, as exemplified by U.S. Pat. No. 2,041,775, No. 2,266,537, No. 2,498,127, No. 2,574,869, No. 3,257,526, No. 3,405,380, No. 3,546,652, No. 3,634,801, No. 3,688,060 and No. 3,713,062 contains a number of thermally operated relay devices. Some of the prior art devices employ snap acting elongated bimetal members heated by internal current and upon which contacts are mounted; other devices employ elongated non-snap-acting bimetal elements having a free end engaging an elongated member slidable in housing for operating a switch, such as a snap-acting switch; still other prior art devices employ a plurality of snap-acting discs heated by separate heaters and which engage slidable motion transfer pins engaging flexible contact arms. Heating of bimetal elements, either by internal resistance heating or by heating coils wound on the bimetal elements in thermo-relays results in repeated flexing of leads and/or coils causing failure of such leads and/or coils. Snap acting switches usually employ separate spring devices, or the like, for producing a snap action in closing the switches resulting in higher cost for thermo relays containing such thermo relays. Snap acting discs are generally formed with considerable die force producing appreciable metal flow to provide the disc shape required for snap action, resulting in increased costs and/or less uniformity in the temperature response of the discs. Also, prior art thermo relays using a sliding member in a housing wherein the member is moved in one direction by a resilient contact arm can result in significant reduction of contact force due to friction forces or gravity forces on the sliding member.

The prior art also contains a number of heating systems employing thermally operated relays to sequentially energize heating elements, as exemplified in U.S. Pat. No. 3,046,380, No. 3,242,978, No. 3,329,869, No. 3,351,739, No. 3,588,471, No. 3,659,155 and No. 3,770,977. Generally, air blowers in such heating systems must be maintained in operation when any of the heating elements is energized to prevent burn out or failure of the heating elements. Some of the prior art systems utilize a lower temperature operated thermoswitch device than that employed to energize heating elements, and others employ heater element current sensing facilities for maintaining air blower operation.

SUMMARY OF THE INVENTION

The invention is summarized in that an electro-thermal operated relay includes a housing, an electrical switch mounted in the housing, an elongated strip-like bimetal element formed with a transverse curvature which is straightened by transverse temperature warp of the bimetal element produced by increasing temperatures, the transverse curvature retaining the bimetal element against longitudinal curvature until a temperature is reached whereat longitudinal curvature forces exceed retaining forces of the transverse curvature producing a snap longitudinal curvature change, means for securing one point of the bimetal element to the housing such that one end of the bimetal element extends free, electric heating means mounted in the housing for heating the bimetal element, and an operator disposed in the housing between the one end of the bimetal element and the electrical switch for operating the electrical switch when the bimetal element changes longitudinal curvature.

An object of the invention is to construct a snap acting electrothermal relay with a new and improved combination of elements which is less expensive and more reliable than prior art electrothermal relays.

Another object is to construct an electrothermal relay utilizing a simplified construction for sequentially operating two or more switches.

It is also an object of the invention to provide an electric sequencing relay having a design which can be readily changed or adapted to a wide variety of modifications.

A further object of the invention is to construct a heating system which insures air blower operation when any heating element is energized.

Additional features of the invention include the provision of a thermo-conductive support with a heating coil thereon for supporting and providing heat to an elongated bimetal element; the provision of a tapered free end on an elongated bimetal element eliminating the necessity for heating such free end; the provision of a plurality of elongated snap acting bimetal elements mounted on a single support and heated by a heating coil attached to the support; the provision of separate compartments in a thermal relay containing power switches; the provision of a slidable operator with a slot for engaging the free end of a bimetal element to eliminate the need for switch contact arm bias for moving the slidable operator; and the provision of a single-pole double-throw switch in an electric heat sequencing system to switch a blower control relay from thermostat operation until heating elements have been sequentially deenergized.

BRIEF DESCRIPTION OF THE DRAWINGS

FIG. 1 is a diagram of an electrical circuit portion of an electric heating system in accordance with the invention.

FIG. 11 is a diagram of a variation of the heating system circuit shown in FIG. 1.

FIG. 12 is a diagram of still another variation of the heating system circuit shown in FIG. 1.

DESCRIPTION OF THE PREFERRED EMBODIMENTS

Figure 3:
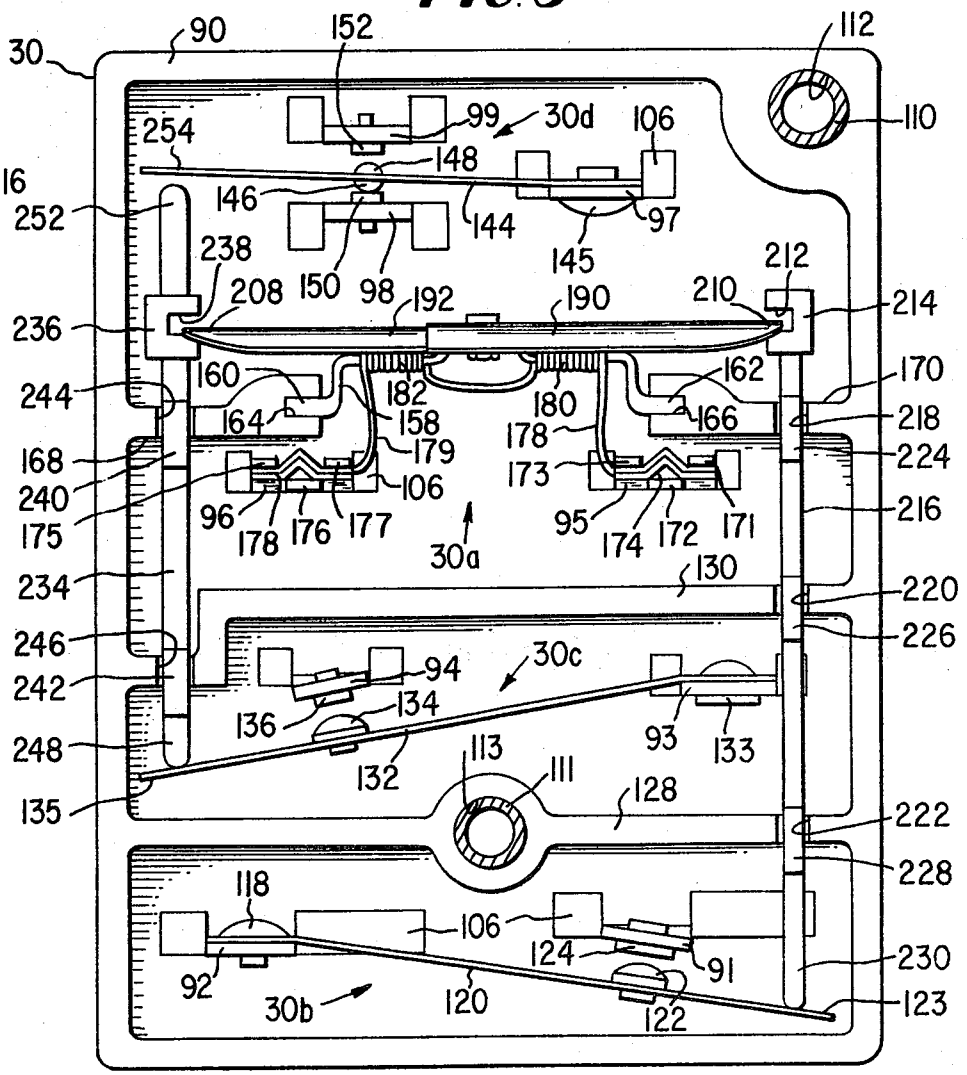
FIG. 3 is a back view of the sequencer of FIG. 2 with the back cover plate removed.

As is illustrated in FIG. 1, the invention is embodied in an electrical circuit for an electric heating system including electrical heating elements 20, 22, 24 and 26 and a blower motor 28 operated by relays 30 and 32 controlled by a thermostat switch device 34 for sequentially energizing and deenergizing the elements 20, 22, 24 and 26 while maintaining the blower motor 28 operating when any of the elements 20, 22, 24 and 26 is energized. The electrical heating elements 20, 22, 24 and 26 are conventional resistance heating elements mounted in a suitable heat exchange chamber (not shown) through which a fluid flow such as air, is controlled by a fluid flow device, such as an air blower (not shown) driven by the motor 28, to provide for heat transfer to a room where the thermostat 34 is positioned. Since constructions of suitable heat exchange chambers, air blowers, and ducts are well known and are described in the prior art, they are not described in detail herein.

The sequencer 30 includes a heat motor indicated generally at 30*a*, normaly open power switches indicated generally at 30*b* and 30*c* and a single-pole double-throw low voltage control switch indicated generally at 30*d*. Similarly the sequencer 32 includes a heat motor indicated generally at 32*a*, normally open power switches indicated generally at 32*b* and 32*c* and single-pole double-throw low voltage control switch indicated generally at 32*d*. The thermostat switch device 34 is a conventional thermostat which has contacts 34*a* which close at temperatures below a selected temperature and open at temperatures above the selected temperature.

In the power circuit for energizing the heating elements 20, 22, 24 and 26, one side of the normally open switch 30*b* is connected to a power line 38 while the electric heating element 20 and the blower motor 28 are connected in parallel between the other side of the switch 30*b* and a power line 40. One side of the switch 30*c* is connected to the power line 38 while the heating element 22 is connected between the other side of the switch 30*c* and the power line 40. One side of the switch 32*b* is connected to a power line 42 while the heating element 24 is connected between the other side of the switch 32*b* and a power line 44. Similar, one side of the switch 32*c* is connected to the power line 42 while the resistance element 26 is connected between the other side of the switch 32*c* and the power line 44. The power lines 38 and 40 are connected across a suitable power source, such as a 120 or 240 volt 60 hertz alternating current source, while the power lines 42 and 44 are also connected across the same or a similar power source.

A low voltage control circuit includes a step-down voltage transformer, such as a 240 volt to 24 volt transformer 46, having its primary winding connected acrosss the power lines 38 and 40 with its secondary winding in a series circuit through the heat motor 30*a*, the contact arm of the switch 32*d*, the normally closed contact of the switch 32*d*, a terminal W1 of a low voltage terminal block 48, the contacts 34*a* of the thermostat device 34 and terminal R of the low voltage terminal block 48. Another circuit across the secondary of transformer 46 includes the normally open contact of switch 30*d*, the contact arm of the switch 30*d*, a terminal A1 of the low voltage terminal block 48, a jumper wire 50, a terminal A2 of the low voltage terminal block 48, the heat motor 32*a*, a terminal W2 of the terminal block 48, a jumper wire 52, the terminal W1, and the thermostat contacts 34*a* to the terminal R when the switch 30*d* is operated. The normally open contact of the switch 32*d* is connected to the terminal R of the low voltage terminal block 48 to form a circuit through the heat motor 30*a*, the contact arm of the switch 32*d*, and the normally open contact of the switch 32*d* to the terminal R when the switch 32*d* is operated.

Figure 2:
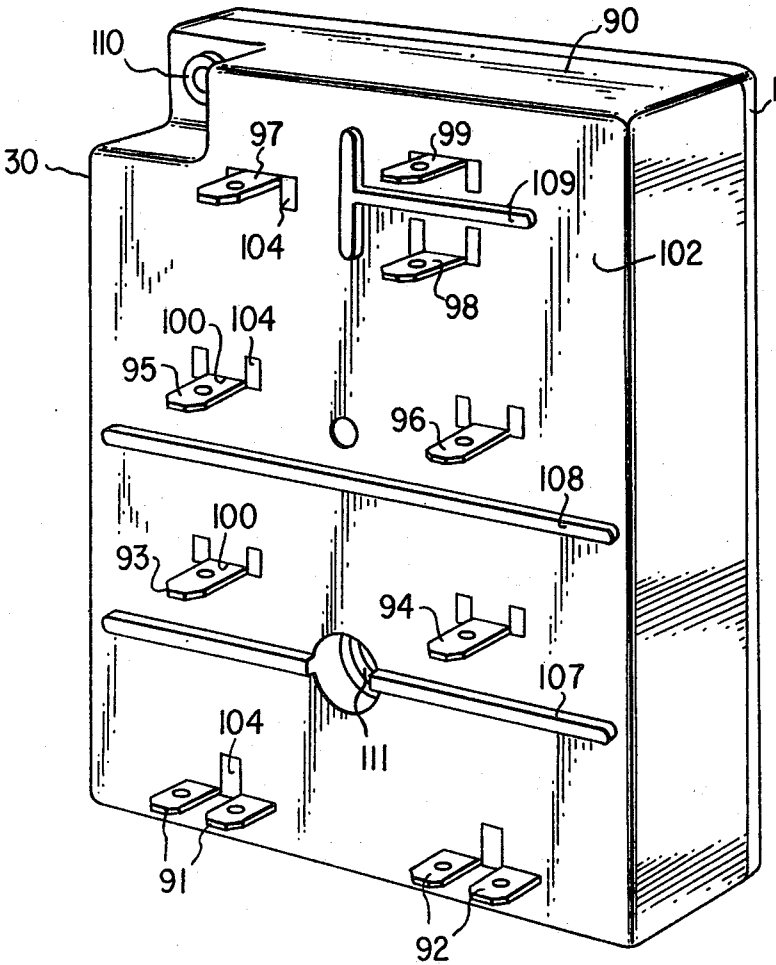
FIG. 2 is a prospective view of a thermal sequencing relay or sequencer for use in the heating system of FIG. 1.

As illustrated in FIGS. 2 and 3, the sequencer 30, which is substantially similar to the sequencer 32, includes a housing 90 made of a suitable insulative material, such as a phenolic resin, and having electrically conductive terminals 91, 92, 93, 94, 95, 96, 97, 98 and 99 extending through slots 100 in a front wall 102 of the housing 90. The terminals 91 through 99 are formed from metal strips and have portions projecting outward from the housing 90 forming quick connect and disconnect terminals for securing suitable connectors and leads thereto for making the electrical circuit connections shown in FIG. 1 to the sequencer 30; the terminals 91 and 92 each having a pair of outward projecting portions for securing a pair of connectors thereto. Tab portions 104 of the terminals 90 through 99 are bent into engagement and recessed in the outside surface of the front wall 102 while tab portions 106 of the terminals 91 through 99 are bent into engagement with the inside or interior surface of the front wall 102 for firmly securing the terminals 91 through 99 in the slots 100 through the front wall 102 of the housing 90. Ribs 107, 108 and 109 are provided on the exterior surface of the wall 102 to increase electrical isolations of the terminals 91 through 99. Tubular rivets or eyelets 110 and 111 extend through holes 112 and 113 in recessed portions of the front wall 102 and through holes (not shown) in a back cover 116 for securing the back cover 116 to the housing 90. The eyelets 110 and 111 have a suitable size for receiving screws or bolts (not shown) to mount the housing 90 on a suitable support (not shown).

Inside of the housing 90, as shown in FIG. 3, a rivet 118 secures one end of a resilient flexible contact arm 120 on the terminal 92. A movable contact 122 is mounted on the arm 120 intermediate the secured end and a free end 123 of the arm 120. The movable contact 122 is aligned for engaging a stationary contact 124 which is mounted on the terminal 91. The power switch 30*b*, which includes the contact arm 120 and contacts 122 and 124, is isolated within a chamber formed by a partition or wall 128 within the housing 90. Similarly the power switch 30*c*, isolated in a chamber formed by a wall or partition 130, includes a resilient contact arm 132 mounted by a rivet 133 on the terminal 93, a movable contact 134 attached to the arm 132 intermediate its secured end and a free end 135, and a stationary contact 136 mounted on the terminal 94 in alignment to be engaged by the movable contact 134. The control switch 30*d* includes a resilient contact arm 144 mounted by a rivet 145 on the terminal 97, movable contacts 146 and 148 mounted on opposite sides of the contact arm 144, and stationary contacts 150 and 152 mounted on the respective terminals 98 and 99 in alignment with the respective movable contacts 146 and 148. The arms 120, 132 and 144 are formed of suitable relatively conductive and resilient metals, such as beryllium copper, and are mounted on the terminals 92, 93 and 97 such as to urge the movable contacts 122, 134 and 146 into engagement with the respective stationary contacts 124, 136 and 150; the arm 144 urging the movable contact 148 away from the stationary contact 152.

The heat motor 30*a* includes an inverted U-shaped member 158 having outwardly flared ends 160 and 162 supportingly engaged within slots 164 and 166 formed in respective projecting portions 168 and 170 of the housing 90. The inside end of the terminal 95 is split into three projecting prongs 171, 172 and 173 between which are wedged a connector 174. Similarly, the inside end of the terminal 96 is split into three projecting prongs 175, 176 and 177 between which are wedged a connector 178. The connectors 174 and 178 are conductive metal strips which are folded over insulation-stripped portions of ends 178 and 179 of a resistance wire wound into equal divided coil portions 180 and 182 on opposite sections of the member 158. The folded connectors 174 and 178 are clinched into a W-configuration prior to being forced between the prongs to insure a good electrical connection to the heat wire ends 178 and 179.

Figure 4:
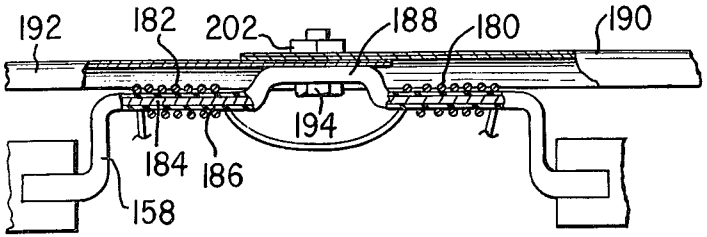
FIG. 4 is a detailed view partially in cross section of a broken away portion of the sequencer as shown in FIG. 3.

As shown in FIG. 4, the member 158 is formed from a thermally conductive strip 184 which is coated, at least on the surfaces where the coil portions 180 and 182 are mounted, with a thin electrically insulative film 186. A suitable material for the metal strip 184 can be selected from heat resistant metals, such as the stainless steels, while the film 186 can be formed by dip-coating or wrapping a film of insulative material such as polyimide plastic sold under the trademark KAPTON by DuPont, E. I. de Nemours & Co., Inc., on the strip 184. A film 186 having a thickness in the range from 0.0254 to 0.0508 millimeters (1 to 2 mils) provides suitable electrical insulation while permitting thermal conductivity through the film 186. The resistance wire forming coil portions 180 and 182 is a suitable insulated resistance wire, such as a glass fiber covered wire, which has a suitable resistance to form an electrical heater with a positive temperature coefficient of resistance. One suitable insulated resistance wire is a nickel alloy BALCO sold by Wilbur B. Driver Co., of Newark, N.J. An upward extending boss 188 is formed in the member 158 and has one end of elongated and strip-like bimetal members or elements 190 and 192 secured thereto, such as by a rivet, or a bolt 194 extending through aligned openings in the boss 188 and the bimetal elements 190 and 192 and secured by a nut 202. The boss 188 is suitably formed to support the bimetal elements 190 and 192 in a spaced relationship above the portions 180 and 182 of the heater coil.

Figure 5:
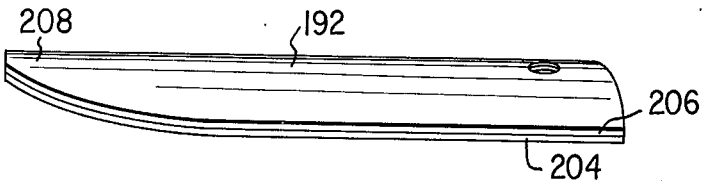
FIG. 5 is a detailed view of a bimetal element in a low temperature state of the sequencer of FIGS. 2 and 3.
Figure 6:
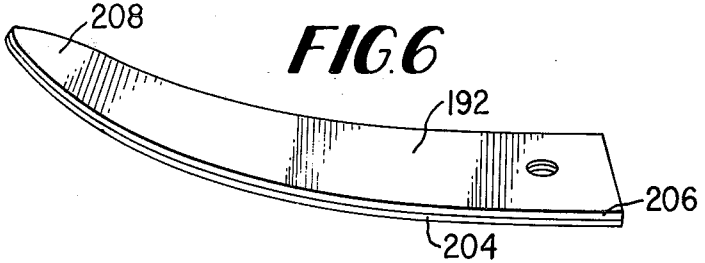
FIG. 6 is a view similar to FIG. 5, but illustrating a high temperature state of the bimetal element.

Referring to FIGS. 5 and 6, the bimetal element 192 includes a layer 204 of a metal with a relatively large positive coefficient of thermal expansion bonded to a layer 206 of a metal with a substantially lesser coefficient of the thermal expansion. The grain directions of the bimetal element 192 generally run along the longitudinal direction of the elements 192. The bimetal element 192 is formed or bent, at about room temperature, into a longitudinal radius of curvature as shown in FIG. 6. Then the bimetal element 192 is formed or bent into a transverse radius of curvature as shown in FIG. 5 to normally hold the bimetal element 192 longitudinally straight at temperatures less than a predetermined temperature which is substantially above the normal room temperature of formation. The transverse curvature of the bimetal element 192 is selected in consideration with the relative coefficients of thermo expansion of the layers 204 and 206 to resist longitudinal curvature or temperature warp until the predetermined temperature is reached where the transverse warp reduces the degree of transverse curvature or flattens the bimetal element 192 until the sum of the forces generated by the longitudinal temperature warp and the stress resulting from the longitudinal curvature in formation of the element 192 exceed the retaining forces of the transverse curvature for producing an upward snap action movement of a free end 208 of the bimetal element 192. The metals of the layers 204 and 206 are further selected to be essentially resilient throughout their ranges of curvature produced by temperature changes to allow the element 192 to snap back to its position in FIG. 5 when the temperature is reduced to a temperature which is slightly less than the predetermined temperature and when the stress from the formed transverse curvature exceeds the sum of the temperature warp forces and the stress of the formed longitudinal curvature. The corners of the free end 208 of the bimetal element 190 are removed to form a tapered end.

The bimetal element 190 is similar to the bimetal element 192 except that the bimetal element 190 is selected to operate at a lower temperature than the bimetal element 192. Since temperature of operation is determined by the degree of transverse curvature when the other relative parameters are about equal in the elements 190 and 192, making the bimetal element 190 with a larger transverse radius of curvature, i.e., more flat, than the element 192 results in the element 190 snapping to its raised or longitudinally curved position and returning to its longitudinally straight position at significantly lower operating temperatures than the respective operating temperatures of the element 192. The bimetal element 190 is mounted on top so that its inside curved surface is next to the outside transverse curved surface of the bimetal element 192.

The tip or free end 210 of the bimetal element 190 extends into a transverse slot 212, FIG. 3, formed within an enlarged portion 214 of an elongated switch operator 216 which slidably extends through slots 218, 220 and 222 formed within the respective portion 170, partition 130 and partition 128 to be moved therein by the movement of the end 210. The operator 216 is formed of a rigid insulative material such as a phenolic resin and has portions 224, 226 and 228 which have rectangular transverse cross sections mating with the slots 218, 220 and 222 such as to prevent rotation of the operator 216 about a longitudinal axis. The operator 216 has a length designed to engage an end 230 of the operator against the free or unsecured end 123 of the switch arm to normally force the switch arm 120 to a position disengaging the movable contact 122 from the stationary contact 124 when the bimetal element 192 is in its low temperature state or is longitudinally straight, and to disengage the end 230 from the end 123, FIG. 7, when the bimetal element 190 is in its high temperature or longitudinally curved state.

An elongated switch operator 234 has an enlarged portion 236 with a slot 238 for receiving the tip or free end 208 of the bimetal element 192. The operator 234, formed of a material similar to the operator 216, has portions 240 and 242 with rectangular transverse cross sections slidably extending within slots 244 and 246 formed in the respective portion 168 and the partition 130 for slidably supporting the operator 234 while preventing rotation of the operator 234. The lower end 248 of the operator 234 extends such as to engage the free end 135 of the switch arm 132 to normally disengage the movable contact 134 from the stationary contact 136 when the bimetal element 192 is longitudinally straight or in its low temperature state, and to disengage the end 248 from the end 135, FIG. 8, when the bimetal element 192 is in its high temperature state. The upper end 252 of the operator 234 is disposed beneath a free end 254 of the switch arm 144 to allow the resilient arm 144 to normally bias the movable contact 146 into engagement with the normally closed contact 150. The operator 234 has a length extending to its end 252 designed to engage the end 254 of the contact arm 144 and move the contact 146 from engagement with the contact 150 and to move the movable contact 148 into engagement with the stationary contact 152 when the bimetal element 192 changes to its high temperature state where it is longitudinally curved.

The various parameters of the heating coil portions 180 and 182 and the bimetal elements 190 and 192 are selected to produce suitably delay opeating and return times for the bimetal elements 190 and 192 when the heating coil is energized and deenergized. For example, such parameters can be selected to change the bimetal element 190 to its high temperature state about 25 seconds after energization of the heating coil portionss 180 and 182, and to return the bimetal element 190 to its low temperature state about 60 seconds after deenergization of the heating coil portions 180 and 182; and such parameters can be selected to snap the bimetal element 192 to its high temperature state about 45 seconds after energization of the heating coil portions 180 and 182, and to return the bimetal element 192 to its low temperature state about 40 seconds after deenergization of the heating coil portions 180 and 182.

In operation of the electric heating system circuit shown in FIG. 1, the thermostat 34 operates the sequencers 30 and 32 to sequentially energize the heating elements 20, 22, 24 and 26 and to sequentially deenergize the heating elements 26, 24, 22 and 20 maintaining the blower motor 28 energized while any of the heating elements 20, 22, 24 and 26 is energized.

More particularly, a decrease in room temperature below the selected temperature of the thermostatic switch device 34 closes contacts 34*a* connecting the terminal R to terminal W1 energizing the heat motor 30*a* of the sequencer 30. After a first delay, switch 30*b* closes applying electric power to the heating element 20 and to the blower motor 28. After a second delay, the switch 30*c* of the sequencer 30 closes energizing the heating element 22, and the switch 30*d* operates energizing the heat motor 32*a*. The sequencer 32 delays closing the switch 32*b* energizing the heating element 24, and then after a further delay closes the switch 32*c* energizing the heating element 26. Thus, the heating elements 20, 22, 24 and 26 are sequentially connected to the power source thus avoiding excessive voltage and current surges produced in the power lines 38, 40, 42 and 44 which would occur if all of the heating elements 20, 22, 24 and 26 were energized at the same time.

Simultaneously with the closing of the switch 32*c*, the single-pole double-throw switch 32*d* operates disconnecting the heat motor 30*a* and the contact arm of the switch 32*d* from the normally closed contact of the switch 32*d* and the circuit through the thermostat contacts 34*a*, and connecting the contact arm of the switch 34*d* to the normally open contact of the switch 34*d* to bypass the thermostatic contacts 34*a*. When the room temperature again reaches the selected temperature of the thermostat 34, the contacts 34*a* open deenergizing the heat motor 32*a* which, after a delay, opens the switch 32*c* deenergizing the heater element 26, and returns the contact arm of the switch 32*d* from the normally open contact to the normally closed contact to deenergize the heat motor 30*a*. Then the switches 32*b* and 30*c* sequentially deenergize the heating elements 24 and 22. Lastly, the switch 30*b* opens simultaneously deenergizing the heating element 20 and the blower motor 28. The switch 30*d* disconnects its contact arm from its normally open contact to disconnect the heat motor 32*a* from the thermostat switch 34*b* preventing operation of the sequencer 32 by a subsequent closing of contacts 34*a* until after the sequencer 30 operates.

Figure 7:
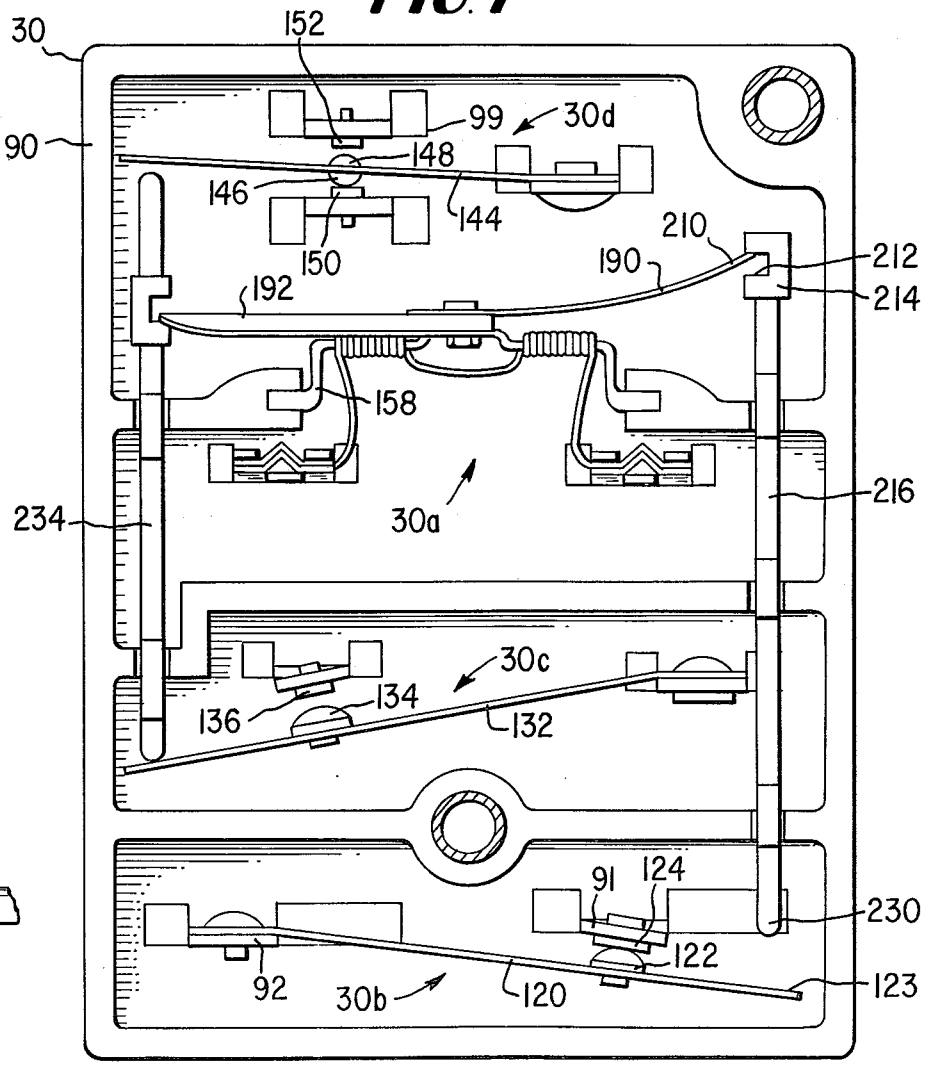
FIG. 7 is a view similar to FIG. 3 but illustrating a first bimetal element in a high temperature state.
Figure 8:
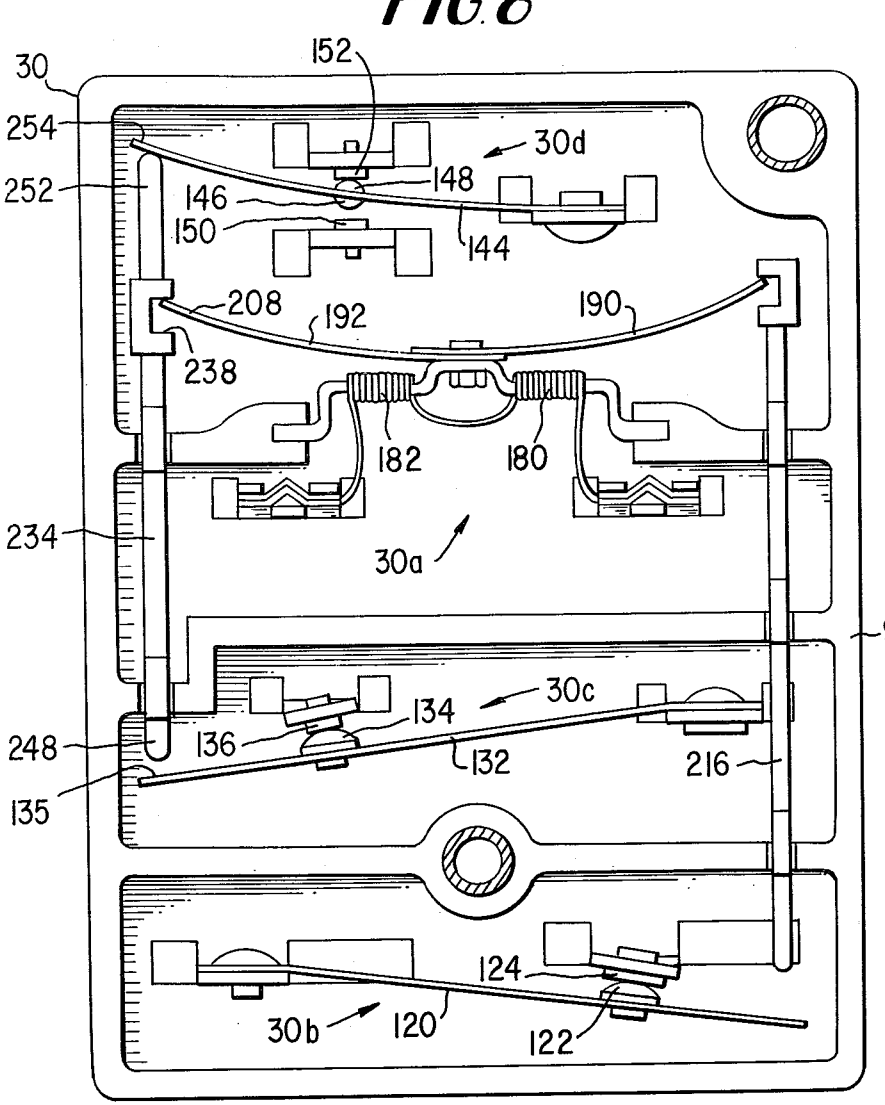
FIG. 8 is a view similar to FIGS. 3 and 7 but illustrating first and second bimetal elements in high temperature states.

Referring to FIGS. 2 and 3 when the heat motor 30*a* is energized by applying voltage across terminals 95 and 96, heat from the heater coil portions 180 and 182 begins raising the temperature of the bimetal elements 190 and 192. At a first temperature the bistable element 190 snaps to its high temperature state as shown in FIG. 7 whereupon the tip 210 engages the enlarged portion 214 on the upper surface of the slot 216 and moves the operator 216 upward pulling its end 230 out of engagement with the end 123 of the resilient switch arm 120 to allow the full resilient force of the arm 120 to snap the movable contact 122 into engagement with the stationary contact 124. This closes the switch 30*b* allowing electrical current to flow between the terminals 91 and 92. After a further duration and a further increase in the temperature of the bimetal elements 190 and 192 the bimetal element 192 snaps to its high temperature state, as shown in FIG. 8 causing the tip 208 to engage the upper surface of the slot 138 and move the operator 234 upward. In its upward movement, the end 252 of the operator 234 engages the free end 254 of the contact arm 144 disengaging the movable contact 146 from the stationary contact 150; and engaging the movable contact 148 with the stationary contact 152; this operates the single-pole double-throw switch 30*d* opening the circuit between the contact arm 144 and the normally closed contact 150 and closing circuit between the contact arm 144 and the normally open contact 152. Simultaneously the lower end 248 of the operator 234 moves upward allowing the free end 135 of the switch arm 132 and contact 134 to move upward engaging the movable contact 134 with the stationary contact 136 to close the switch 30*c*.

When the heat motor 30*a* is deenergized, the coil portions 180 and 182 cool allowing the bimetal elements 190 and 192 to cool. After a duration, the bimetal element 192 snaps from its high temperature state to its low temperature state, FIG. 7 opening the switch 30*c* and operating the switch 30*d* to engage contact 146 with contact 150 and to disengage contact 148 from contact 152. Upon further cooling, the bimetal element 190 snaps to its low temperature state opening the switch 30*b*, FIG. 3.

The principle quantity of heat transferred from the portions 180 and 182 of the heat motor coil to the bimetal elements 190 and 192 is believed to be transferred by conduction through the U-shaped member 158 to the secured ends of the bimetal elements 190 and 192; the thin insulating layer 186, FIG. 1, has substantially less heat resistance than the space of air between the coil portions and the bimetal elements 190 and 192. Lesser quantities of heat are transferred by way of radiation and convection from the heating elements 180 and 182 to the bimetal elements 190 and 192. Having the heater coil split in two equal portions 180 and 182 promotes even heating of the bimetal elements 190 and 192. Having the portions 180 and 182 disposed directly beneath the bimetal elements 190 and 192 serves to partially surround the heating coil portions 180 and 182 on the upper side of the heating coil portions thus tending to prevent excessive loss of heat through radiation and convection currents. With the corners of the tips 208 and 210 of the bimetal elements 190 and 192 removed to form tapered ends, the bimetal elements 190 and 192 operate with less heat transfer from the supported ends to the tapered ends 208 and 210 due to the lesser degree of transverse curvature at the ends 208 and 210. Also the tapered ends 208 and 210 result in a more even operation of the bimetal elements 190 and 192 since the lesser degree of transverse curvature at the tips 208 and 120 allows operation at the lower temperature at the tips 208 and 210 due to the temperature gradient through the lengths of the bimetal elements 190 and 192.

The combination of the elongated snap acting bimetal element 190 supported at one point or end with the free end 210 engaging the operator 216 which is slidably mounted for operating the switch **30*b* results in a relatively low cost and reliable snap acting thermal relay. It is the particular structure of the bimetal element 190**, i.e., the cold formed transverse curvature opposing temperature warp and retaining the bimetal element against longitudinal curvature, that makes this combination possible.

The employment of the heater coil wound on the thermo-conducting support 158 makes possible the mounting of a plurality of snap acting bimetal elements on the support as well as providing a thermoconductive path for heat flow which can be easily made relatively uniform in relays manufactured in large quantities. Mounting the one end of the lower-temperature-operating bimetal element 190 overlapping the one end of the bimetal element 192 with the inside curvature of element 190 next to the outside curvature of element 192 allows both bimetal elements to be mounted at the same point on the support 158 without effecting the operation of either element; i.e., the bimetal element 190 first becomes flat in the transverse dimension not interfering with the element 192 later becoming transversely flat, and the element 192 first becomes transversely curved not interfering with the element 190 later becoming transversely curved. Switch operation of the sequencer 30 is enhanced by the free end 210 of the bimetal element 190 engaging the slide operator 216 in the slot 212. The lifting of the end 230 from the switch arm 120 and allowing the full resilient force of the arm 120 to engage the movable contact 122 with the stationary contact 124 produces improved electrical engagement between the contacts 122 and 124. Also, the use of the slot 238 in the operator 234 for receiving and engaging the free end 208 allows two switches to be operated by opposite ends of the operator 234.

Figure 9:
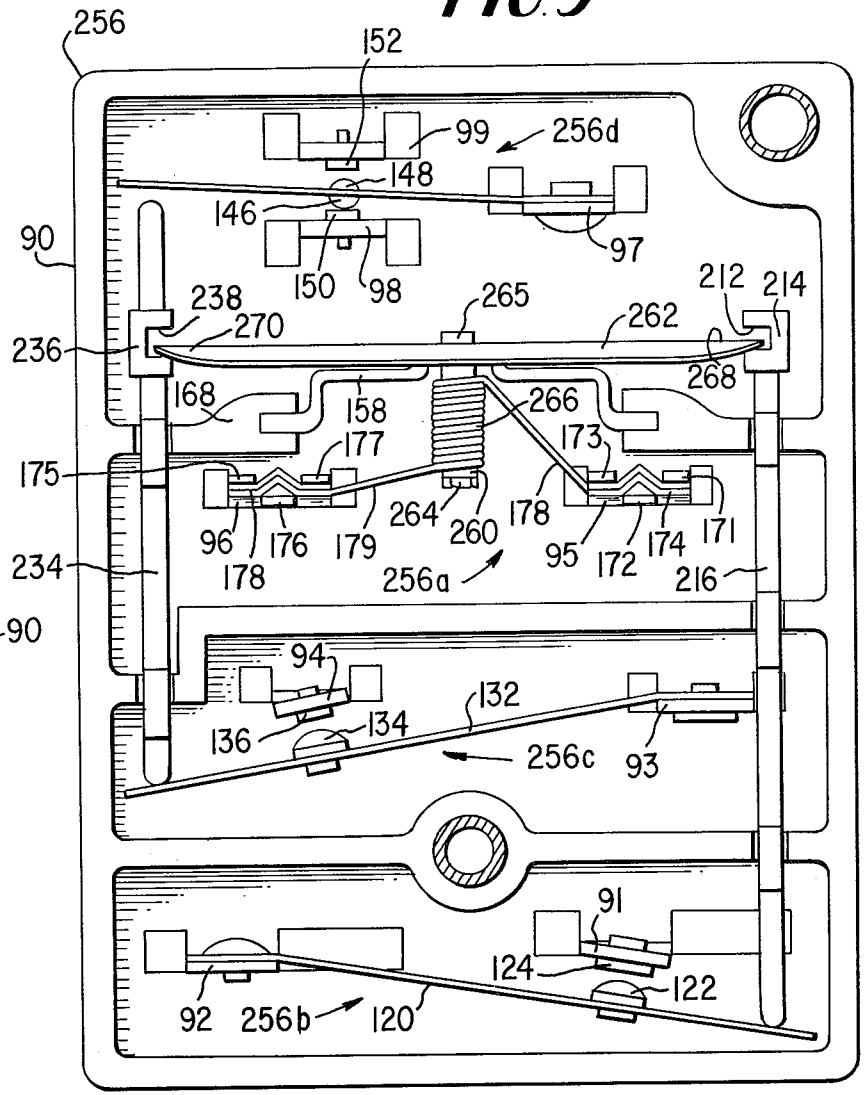
FIG. 9 is an elevation back view with a back cover removed of a modified sequencer.

In FIG. 9, there is shown a modified sequencer 256 with parts identified by the same numbers identifying parts in FIG. 3 illustrating that such parts have the same or similar structure and/or function. The modified sequencer 256 has a heat motor indicated generally at **256*a* which has a tubular conductive extension or post 260 and a bimetal element 262 attached by a bolt 264 and a nut 265 to the inverted U-shaped member 158. The post 260 is a section of thermoconductive tube, such as an aluminum tube which has an outer thin layer or film of electrical insulation similar to the layer 186, FIG. 4, upon which a coil 266 of insulated electrical resistance wire is wound. The ends 178 and 179 of the resistance wire are connected to the terminals 95 and 96 as previously described. The bimetal element 262 has its center point mounted on the member 158 and tapered free ends or tips 268 and 270 extending in opposite directions from the center point into the respective slots 212 and 238 of the operators 216 and 234. Similar to the bimetal elements 190 and 192 of the sequencer 30, the bimetal element 262** has a cold formed longitudinal curvature which is held straight by a cold formed transverse curvature opposite to the warp produced by increasing temperatures.

In operation of the modified sequencer 256, the free ends 268 and 270 will snap upward and downward substantially simultaneously to operate switches **256*b*, 256*c* and 246*d*** simultaneously.

One advantage of the structure of sequencers 30 and 256 is that the sequencers can be easily manufactured in many variations or modified forms. For example, in FIG. 10, there is shown a modified sequencer generally indicated at 272 in which the control or auxilliary switch is eliminated. In the modified sequencer 272, the terminals 97, 98 and 99, FIGS. 3 and 9, together with the contacts 146, 148, 150 and 152 and with arm 144 are left out in the manufacture of the sequencer 272 to eliminate unnecessary structure and reduce cost where such structure and its function are unnecessary. The slots 100 in the housing 90 for receiving the terminals can be left open, or closed with a break out web formed in molding the housing 90. It is also noted that the sequencer 272 uses the single bimetal element 262, FIG. 9.

Many other variations of the basic sequencer to FIG. 3 can be made including the elimination of one of the power switches, for example power switch **30*c* by leaving out the terminals 93 and 94 together with the contacts 134 and 136 and the contact arm 132 or the elimination of terminal 98 and contact 150, thus converting the switch 30*d*** into a normally open single-pole single-throw switch.

Figure 10:
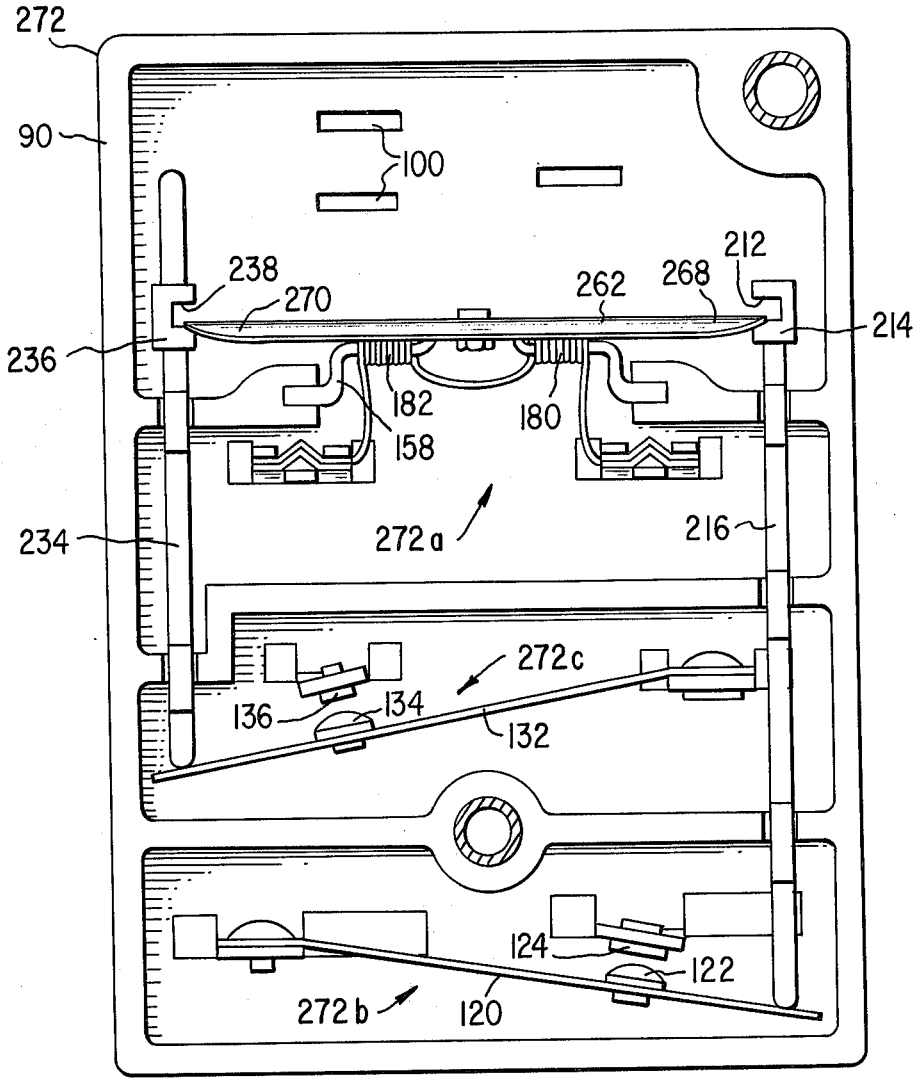
FIG. 10 is an elevation back view with the back cover removed of a further modification of the sequencer.

The circuit shown in FIG. 11 illustrates the use of a modified sequencer 276 which does not have a control switch similar to sequencer 272, FIG. 10, but includes two bimetal elements similar to sequencer 30, FIG. 3 for sequentially operating switches **276*b* and 276*c*. One side of the normally open switch 276*b* is connected to the power line 38 while the blower motor 28 and the heat resistance element 20 are connected between the other side of the switch 276*b* and the power line 40. Similarly, one side of the switch 276*c* is connected to the power line 38 while the heat resistance element 22 is connected between the power line 40 and the other side of the switch 276*c*. The contacts 34*a* of the thermostat 34 are connected between the terminals R and W of the low voltage terminal block 48 in series with the heat motor 276***a* across the secondary of the transformer 46.

In operation of the modification shown in FIG. 11, the closing of the thermostat contacts 34*a* energizes the heat motor 276*a* which after a delay first closes switch 276*b* energizing the heating element 20 and the blower motor 28. After a further delay, the switch 276*c* closes energizing the heat resistance element 22. When the temperature sensed by the thermostat 34 rises to the selected temperature, the thermostat 34*a* opens deenergizing the heat element 276*a* which, after a first duration, opens the switch 276*c* deenergizing the element 22, and after a second duration, opens the switch 276*b* deenergizing the heating element 20 and the blower motor 28.

FIG. 12 illustrates a circuit which employs the sequencers 256 and 272. The switches 256*b* and 272*b* are connected in parallel to each other and in series with the blower motor 28 across the power lines 38 and 40. One side of the switch 256*c* is connected to the power line 38 while the heater element 20 is connected between the power line 40 and the other side of the switch 256*c*. One side of the switch 272*c* is connected to the power line 38 while the heater element 22 is connected between the power line 40 and the other side of the switch 272*c*. The heat motor 256*a* is connected in series with the thermostat contacts 34*a* across the secondary of the transformer 46. The contact arm and the normally open contact of the switch 256*d* are connected in series with the heat motor 272*a* across the secondary of the transformer 46.

In operation of the circuit variation of FIG. 12, the blower motor 28 and the heating elements 20 and 22 are energized by separate switches 256*b*, 256*c* and 272*d*. Switches 256*b*, 256*c* and 256*d* are operated simultaneously while switches 272*c* and 272*b* are operated after a delay from the closing of switch 256*d*. After opening of thermostat contacts 34*a*, the switches 256*b*, 256*c* and 256*d* are opened after a first delay and then switches 272*b* and 272*c* are opened after a further delay. With the switches 256*b* and 272*b* connected in parallel, the motor 28 remains operating when any of the elements 20 and 22 are energized.

Figure 13:
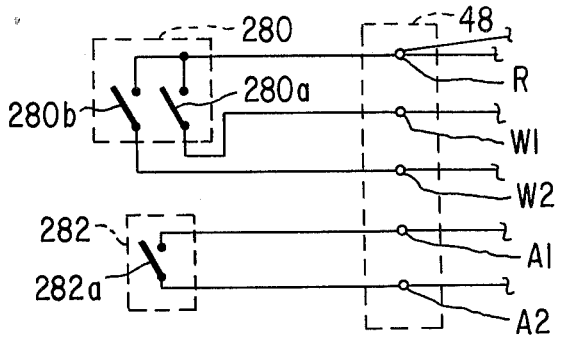
FIG. 13 is a diagram of a modification which can be made to the heating system circuit shown in FIG. 1.

The heating system circuit of FIG. 1 can be adapted for two stage operation and/or outdoor thermostat control as shown in FIG. 13 wherein a two stage thermostat device 280 and an outdoor thermostat 282 are added. First stage contacts 280*a* of the thermostat 280 are connected across the terminals R and W2, and contacts 282*a* of the thermostat 282 are connected across terminals A1 and A2. First stage contacts 280*a* close at temperatures below a first selected temperature while second stage contacts 280*b* close at temperatures below a second selected temperature which is less than the first temperature. Thus, the sequencer 32, FIG. 1 as modified by FIG. 13, will not operate unless both the inside and outside temperatures are below selected temperatures indicating a need by greater heat production.

A three element heating system can be made by using a wiring configuration similar to FIG. 12; but using sequencers with sequential operating switches 256*b*, 256*c*, 272*b* and 272*c* rather than simultaneous, and further connecting an additional element in parallel to the blower motor 28.

Since many modifications, variations, or changes in detail can be made to the present embodiment, it is intended that all matter in the foregoing description or shown in the accompanying drawings be interpreted as illustrative and not in a limiting sense.

What is claimed is:

1. An electrothermal operated relay comprising
a housing,
an electric switch mounted in the housing and having a pair of electrical contacts, one of the pair of contacts being resiliently biased,
an elongated strip-like bimetal element formed with a transverse curvature which is straightened by transverse temperature warp of the bimetal element produced by increasing temperatures, said transverse curvature retaining the bimetal element against longitudinal curvature until a temperature is reached whereat longitudinal curvature forces exceed retaining forces of the transverse curvature producing a snap longitudinal curvature change,
means for securing one point of the bimetal element to the housing such that one end of the bimetal element extends free,
electric heating means mounted in the housing for heating the bimetal element, and
an operator in the housing operatively disposed between the one end of the bimetal element and the electrical switch for moving the one contact against its bias to operate the electrical switch when the bimetal element changes longitudinal curvature.

2. An electrothermal operated relay as claimed in claim 1 wherein the electrical switch is open when the bimetal element is retained by the transverse curvature and the electrical switch is closed when the bimetal element is snapped into the longitudinal curvature change.

3. An electrothermal operated relay as claimed in claim 2 wherein
the electrical switch includes a resilient contact arm engaged by the operator, said resilient contact arm urging the operator against the bimetal element with a force which adds to the longitudinal curvature forces produced by increasing temperatures.

4. An electrothermal operated relay as claimed in claim 1 wherein
there is included a thermal conductive support mounted in the housing,
the one point of the bimetal element is mounted on the thermal conductive support, and
the electric heating means includes a resistance winding on the thermal conductive support.

5. An electrothermal operated relay comprising
a housing,
an electrical switch mounted in the housing,
an elongated strip-like bimetal element formed with a transverse curvature which is straightened by transverse temperature wrap of the bimetal element produced by increasing temperatures, said transverse curvature retaining the bimetal element against longitudinal curvature until a temperature is reached whereat longitudinal curvature forces exceed retaining forces of the transverse curvature producing a snap longitudinal curvature change,
a thermal conductive support mounted in the housing,
means for securing one point of the bimetal element to the thermal conductive support such that one end of the bimetal element extends free, an electric heating means including a resistance winding on the thermal conductive support for heating the bimetal element, said one end of the bimetal element having a tapered transverse dimension, and an operator in the housing operatively disposed between the one end of the bimetal element and the electrical switch for operating the electrical switch when the bimetal element changes longitudinal curvature.

6. An electrothermal operated relay comprising a housing, an electrical switch mounted in the housing, an elongated strip-like bimetal element formed with a transverse curvature which is straightened by transverse temperature wrap of the bimetal element produced by increasing temperatures, said transverse curvature retaining the bimetal element against longitudinal curvature until a temperature is reached whereat longitudinal curvature forces exceed retaining forces of the transverse curvature producing snap longitudinal curvature change, said housing including a pair of projecting portions having opposing inward facing retaining slots formed therein, a thermal conductive support including a U-shaped member having a pair of opposing outward projecting flanges for being retained in the inward facing retaining slots of the projecting portions, means securing one point of the elongated bimetal element to the U-shaped member intermediate the outward projecting flanges of the U-shaped member such that one end of the bimetal element extends free, electric heating means including a resistance winding on the thermal conductive support, and an operator in the housing operatively disposed between one end of the bimetal element and the electrical switch for operating the electrical swtich when the bimetal element changes longitudinal curvature.

7. An electrothermal operated relay comprising a housing, an electrical switch mounted in the housing, an elongated strip-like bimetal element formed with a transverse curvature which is straightened by transverse temperature warp of the bimetal element produced by increasing temperatures, said transverse curvature retaining the bimetal element against longitudinal curvature until a temperature is reached whereat longitudinal curvature forces exceed retaining forces of the transverse curvature producing a snap longitudinal curvature change, means for securing one point of the bimetal element to the housing such that one end of the bimetal element extends free, electric heating means mounted in the housing for heating the bimetal element, an operator in the housing operatively disosed between the one end of the bimetal element and the electrical switch for operating the electrical switch when the bimetal element changes longitudinal curvature, said electrical switch being open when the bimetal element is retained by the transverse curvature and said electrical switch being closed when the bimetal element is snapped into the longitudinal curvature change, said electrical switch including a resilient contact arm engaged by the operator, said resilient contact arm urging the operator against the bimetal element with a force which adds to the longitudinal curvature forces produced by increasing temperatures, said operator having a slot, and said one end of the bimetal element extending into the operator slot for engaging a first surface of the slot to force the contact arm open and for engaging a second surface of the slot to pull the operator from engagement with the resilient contact arm.

8. An electrothermal operated relay as claimed in claim 7 wherein the housing has a partition forming an isolated compartment in the housing, the electrical switch is mounted in the isolated compartment, the partition has a slot for slidably supporting the operator, and the operator has a portion with a rectangular cross-section for mating with the partition slot to prevent rotation of the operator in the partition slot.

9. An electrothermal operated relay comprising a housing, a support centrally positioned in the housing, an elongated strip-like bimetal element mounted on the support and having unsupported ends extending in opposite directions from the support toward sides of the housing, said bimetal element formed with a transverse curvature which is straightened by transverse temperature warp of the bimetal element produced by increasing temperatures, said transverse curvature retaining the bimetal element against longitudinal temperature warp until a temperature is reached whereat longitudinal curvature forces exceed retaining forces of the transverse curvature producing a snap longitudinal curvature change, first and second electrical switches mounted in the housing, an electrical heating means mounted on the housing for heating the bimetal element, and first and second operators operatively disposed between the respective unsupported ends of the bimetal element and the respective first and second electrical switches for operating the electrical switches when the bimetal element changes longitudinal curvature.

10. An electrothermal operated relay as claimed in claim 9 wherein the relay includes a third electrical switch mounted in the housing on an opposite side of the bimetal element from the first electrical switch, and the first operator extends to the opposite side of the bimetal element for operating the third electrical switch.

11. An electrothermal operated relay as claimed in claim 9 wherein the housing has a pair of projecting portions with opposing inward facing retaining slots from therein the support includes a member having a pair of outward projecting flanges for being retained in the inward facing retaining slots of the projecting portions, and the elongated bimetal element is mounted on the member intermediate the flanges.

12. An electrothermal operated relay as claimed in claim 11 wherein the heating means includes a winding of resistance wires wound on the member, and the member is thermally conductive.

13. An electrothermal operated relay comprising a housing, a support mounted on the housing, a pair of elongated bimetal elements mounted at first ends thereof on the support such that second unsupported ends of the bimetal elements extend in opposite directions from the support toward sides of the housing, each of said elongated bimetal elements formed with a transverse curvature which is straightened by transverse temperature warp of the bimetal element produced by increasing temperatures, said transverse curvatures retaining the respective bimetal elements against longitudinal temperature warp until a temperature is reached whereat longitudinal warp forces exceed retaining forces of the respective transverse curvatures producing snap longitudinal curvature changes, electric heating means mounted in the housing for heating the bimetal elements, first and second electrical switches mounted in the housing and having respective pairs of electrical contacts, one of each pair of contacts being resilient biased, and first and second operators in the housing transverse to the first and second elongated bimetal elements, said first insulative operator extending between the unsupported end of the first bimetal element and the first switch for moving the one contact of the first switch against its bias to operate the first switch, said second operator extending between the unsupported end of the second bimetal element and the second electrical switch for moving the one contact of the second switch against its bias to operate the second electrical switch.

14. An electrothermal operated relay comprising a housing, a support mounted in the housing, a pair of elongated bimetal elements mounted at first ends thereof on the support such that second unsupported ends of the bimetal elements extend in opposite directions from the support toward sides of the housing, each of said elongated bimetal elements formed with a transverse currvature which is straightened by transverse temperature warp of the bimetal element produced by increasing temperatures, said transverse curvatures retaining the respective bimetal elements against longitudinal temperature warp until a temperature is reached whereat longitudinal warp forces exceed retaining forces of the respective transverse curvatures producing snap longitudinal curvature changes, a first of said bimetal elements chanaging longitudinal curvature at a lower temperature than the second of the pair of bimetal elements, electrical heating means mounted in the housing for heating the bimetal elements, first and second electrical switches mounted in the housing, and first and second operators operatively disposed in the housing transverse to the first and second elongated bimetal elements, said first operator extending between the unsupported end of the first bimetal element and the first switch for operating the first switch, said second operator slidably extending between the unsupported end of the second bimetal element and the second electrical switch for operating the second electrical switch.

15. An electrothermal operated relay as claimed in claim 14 wherein the first bimetal element has a larger transverse radius of curvature, and the one ends of the bimetal elements are mounted in an overlapping relationship at one point of the support with the inside transverse curved surface of the first bimetal element next to the outside transverse curved surface of the second bimetal element.

16. An electrothermal operated relay comprising an insulative housing, a pair of projecting portions of the housing having opposite inward facing retaining slots formed therein, a U-shaped thermal conductive support having a pair of outward projecting flanges for being retained in the inward facing retaining slots of the projecting portions, first and second elongated strip-like bimetal elements, each formed with a transverse curvature which is straightened by transverse warp of the bimetal elements produced by increasing temperatures, said transverse curvature of each of the first and second bimetal elements retaining the respectie bimetal element against longitudinal temperature warp until respective first and second predetermined temperatures are reached whereat longitudinal warp forces exceed retaining forces of the respective transverse curvatures producing snap longitudinal curvature changes of the respective bimetal elements, said transverse curvature of the first bimetal element having a larger radius of curvature than the second bimetal element such that the second predetermined temperature is higher than the first predetermined temperature, means for mounting one ends of the respective bimetal members at a central point on the U-shaped support so that unsupported ends of the respective bimetal members extend in opposite directions toward opposite sides of the housing, an electrical resistance winding having respective divided portions wound on the U-shaped support on opposite sides of the central point, a first partitition forming a first compartment in the housing, a first power switch mounted in the first compartment and having a first stationary contact, a first resilient arm mounted at its one end in the housing, and a first movable contact mounted on the first resilient arm intermediate the one end and an unsupported end of the first resilient arm, said first resilient arm biasing the first movable contact against the first stationary contact, a second partition forming a second compartment in the housing, a second power switch mounted in the second compartment and having a good stationary contact, a second resilient arm mounted at its one end in the housing, and a second movable contact mounted on the second resilient arm intermediate the one end and an unsupported end of the second resilient arm, said second resilient arm biasing the second movable contact against the second stationary contact, a control switch mounted in the housing and having third and fourth stationary contacts, a third resilient arm mounted at its one end in the housing to extend between the third and fourth stationary contacts, and third and fourth movable contacts mounted on the third resilient arm intermediate the one end and an unsupported end of the third resilient arm, said third resilient arm biasing the third movable contact away from the third stationary contact and the fourth movable contact against the fourth stationary contact, first and second insulative elongated switch operators each having an enlarged portion with a transverse slot for receiving the unsupported end of the respective first and second bimetal elements, said pair of projecting portions and said first and second partitions having respective guide slots for slidably retaining the respective first and second switch operators for longitudinal movement transverse to the first and second bimetal elements and the first, second and third resilient arms, said first and second switch operators having respective transverse rectangular cross sections slidable mounted in respective ones of the guide slots for preventing rotation of the respective first and second switch operators in the guide slots, said first switch operator having an end for engaging the unsupported end of the first resilient arm to hold the first movable contact out of engagement with the first stationary contact when the first bimetal element is retained against longitudinal curvature change and to allow engagement of the first movable contact with the first stationary contact when the first bimetal element is snapped to a longitudinal curvature change, said second switch operator having opposite ends for engaging the respective second and third contact arms to hold the second movable contact out of engagement with the second stationary contact and to allow the fourth movable contact to be biased against the fourth stationary contact when the second bimetal element is retained against longitudinal curvature change, and to disengage the fourth movable contact from the fourth stationary contact and to force the third movable contact into engagement with the third stationary contact when the second bimetal element is snapped to a longitudinal curvature change.

* * * * *